US006901734B2

(12) United States Patent
Fink

(10) Patent No.: US 6,901,734 B2
(45) Date of Patent: Jun. 7, 2005

(54) YARN FALSE TWIST TEXTURING APPARATUS

(75) Inventor: Wolfgang-Peter Fink, Wuppertal (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/872,999

(22) Filed: Jun. 21, 2004

(65) Prior Publication Data

US 2004/0237495 A1 Dec. 2, 2004

Related U.S. Application Data

(63) Continuation of application No. PCT/EP02/14228, filed on Dec. 13, 2002.

(30) Foreign Application Priority Data

Dec. 19, 2001 (DE) ..... 101 62 299

(51) Int. Cl.[7] ..... D01H 7/92
(52) U.S. Cl. ..... 57/284
(58) Field of Search ..... 57/282–292; 28/278, 28/258; 425/378.1

(56) References Cited

U.S. PATENT DOCUMENTS 5,193,293 A 3/1993 Gabalda et al.
5,671,519 A * 9/1997 Naylor ..... 28/249
5,715,670 A * 2/1998 Bartkowiak ..... 57/284
5,918,455 A * 7/1999 Matas Gabalda et al. ..... 57/290
6,026,636 A * 2/2000 Lorenz et al. ..... 57/290
6,041,586 A * 3/2000 Naylor et al. ..... 57/290
6,047,536 A * 4/2000 Naylor et al. ..... 57/290
6,430,912 B2 * 8/2002 Lenz et al. ..... 57/284
2001/0017028 A1 8/2001 Lenz et al.

FOREIGN PATENT DOCUMENTS

EP 0 853 150 A2 7/1998
GB 1 273 272 5/1972

* cited by examiner

*Primary Examiner*—John J. Calvert
*Assistant Examiner*—Shaun R Hurley
(74) *Attorney, Agent, or Firm*—Alston & Bird LLP

(57) ABSTRACT

A yarn false twist texturing apparatus which includes a yarn heater, a yarn cooling device, and a yarn twisting unit serially arranged along a yarn path of travel. The cooling device is composed of a cooling tube, and yarn guides are arranged so that the yarn advances spirally on the surface of the outside periphery of the tube. A yarn lifter is positioned so as to lift the advancing yarn from contact with the outside periphery of the cooling tube over a partial length of the cooling tube, so that the cooling effect can be influenced without significantly changing the spiral looping on the cooling tube.

19 Claims, 4 Drawing Sheets

YARN FALSE TWIST TEXTURING APPARATUS

CROSS REFERENCE TO RELATED APPLICATION

The present application is a continuation of international application PCT/EP02/14228, filed 13 Dec. 2002, and which designates the U.S. The disclosure of the referenced application is incorporated herein by reference.

BACKGROUND OF THE INVENTION

The invention relates to a texturing apparatus for false twist texturing a yarn of the general type is disclosed in EP 0 853 150.

In the known texturing apparatus, a supplied flat yarn is textured by a false twist process. To this end, a false twist that a false twist unit produces in the yarn, is set by a heat treatment and a subsequent cooling. For cooling the false twisted yarn, a cooling tube is used, along the surface of which the yarn advances in spiral form. To change the cooling surface on the surface of the cooling tube as a function of the yarn type, the known texturing apparatus possesses a plurality of movable yarn guides, which change the slope of the spiral cooling zone on the circumference of the cooling tube. The yarn path that forms on the circumference of the cooling tube is called cooling zone. To avoid a too intensive cooling in the case of yarns with a low denier, a very flat angle of slope of the spiral cooling zone is adjusted on the circumference of the cooling tube. However, this changes at the same time the degree of the looping on the cooling tube. With that, the problem arises that it is impossible to adequately decrease in the cooling zone the highly dynamic twist oscillations, which are generated in the yarn by the false twist unit, and which propagate with the false twist against the advancing yarn. Thus, the twist oscillations propagate in the yarn as far back as the heating zone, and lead to an unstable yarn path that negatively affects the heat treatment.

It is an object of the invention to improve a standard texturing apparatus of the initially described type such that it permits influencing the cooling effect on the cooling tube without significantly changing the spiral cooling zone.

SUMMARY OF THE INVENTION

The above and other objects and advantages of the present invention are achieved by the provision of a yarn false twist texturing apparatus of the described type and which includes a cooling tube and a yarn lifter arranged between an inlet yarn guide and an outlet yarn guide, which are arranged at the respective opposite ends of the tube. The yarn lifter guides the yarn within the cooling zone over a partial length wherein the yarn does not contact the outer circumferential periphery of the cooling tube. Along the section of the cooling zone in which the yarn is lifted from the surface of the cooling tube, the yarn undergoes no intensive cooling. With that, it becomes possible to adjust with advantage the degree of the cooling within the cooling zone. A special advantage of the invention lies in that the minimum looping necessary for decreasing the twist oscillations remains unchanged on the cooling tube. Although the yarn length advancing within the cooling zone lengthens as a result of lifting the yarn, a weaker cooling is achieved. Thus, it becomes possible to texture with advantage in particular fine-denier yarns.

According to an advantageous further development of the invention, the yarn lifter may be formed in a simple manner by a holder and a yarn guide. In this case, the holder mounts the yarn guide in spaced relationship with the circumference of the cooling tube, thereby enabling a locally defined lifting of the yarn from the surface of the cooling tube.

Since a modified slope of the spiral cooling zone causes the relative yarn position to change on the circumference of the cooling tube, an advantageous further development proposes to make the holder adjustable in the axial and/or the radial direction for changing the position of the yarn guide relative to the cooling tube. With that, it becomes possible to separate the yarn from the surface of the cooling tube in any desired point of the cooling zone.

An especially simple and very effective variant results by making the holder annular and slipping it over the cooling tube. In this instance, the yarn guide is formed by a groove on the circumference of the holder.

The further development, wherein the yarn lifter is formed by an annular segment with an outer guide edge for guiding the yarn, distinguishes itself by a still greater flexibility in guiding the yarn.

The annular segment which is arranged on the circumference of the cooling tube, may have such a shape that the spacing of the yarn between the guide edge and the surface of the cooling tube differs in the circumferential direction of the cooling tube. This allows to make the partial length as large as possible, in which the yarn has no contact with the cooling tube. On the other hand, an enlargement of the distance between the guide edge and the surface of the cooling tube permits generating an additionally intensive looping friction on the yarn, which advantageously leads to a decrease of the twist oscillations in the yarn.

Advantageously, the annular segment is constructed for adjustment on the circumference of the cooling tube in the axial and/or the circumferential direction.

To change the yarn tension within the false twist zone beyond the extent required by the looping about the cooling tube, a particularly advantageous further development of the invention proposes to associate with the yarn lifter a yarn brake in the path of the yarn. The yarn brake generates an additional friction on the yarn in the region of the non-contacting section.

Advantageously, the yarn brake may be formed by a brake pin, which precedes the yarn lifter in the path of the yarn in such a manner that the yarn loops at least partially about the brake pin before advancing onto the yarn lifter.

An adjustment of the brake pin on the holder or the annular segment of the yarn lifter permits realizing situations with and without a yarn brake. In addition, it is possible to change the degree of the yarn looping about the brake pin.

To increase flexibility with respect to guiding the yarn and the slope of the spiral cooling zone, the inlet yarn guide and the outlet yarn guide or only one of the yarn guides may be made adjustable.

BRIEF DESCRIPTION OF THE DRAWINGS

In the following an embodiment of the apparatus according to the invention is described in greater detail with reference to the attached drawings, in which.

DETAILED DESCRIPTION OF THE PREFERRED EMBODIMENTS

Figure 1:
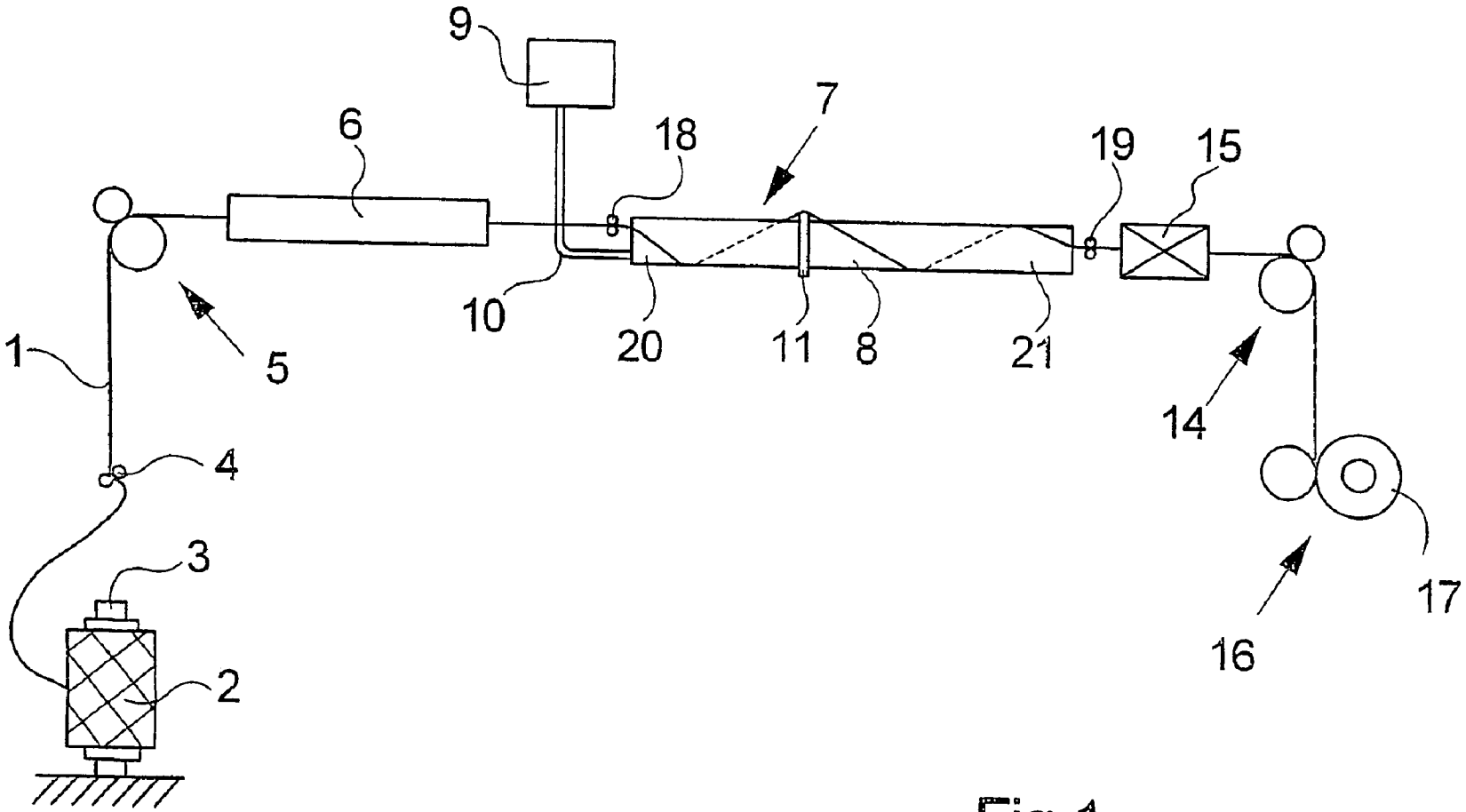
FIG. 1 is a schematic view of the setup of a texturing apparatus according to the invention.

FIG. 1 schematically illustrates the setup of a processing station in a texturing apparatus according to the invention. The texturing apparatus comprises a plurality of processing stations, with the processing units of the processing stations being mounted in one or more machine frames. To texture a yarn 1, a processing station comprises at least one first feed system 5, a heating device 6, a cooling device 7, a false twist unit 15, a second feed system 14, and a takeup device 16.

The processing units are arranged, serially one after the other, to form a yarn path. In the process, the first feed system 5 withdraws a yarn 1 from a feed yarn package 2 via a yarn guide 4. The feed yarn package 2 is creeled on a mandrel 3 of a creel (not shown). The first system 5 advances the yarn 1 into a so-called false twist zone, which extends as far as the false twist unit 15. The false twist unit 15 produces in the yarn 1 a false twist, which returns in the yarn within the false twist zone. To this end, the false twist unit 15 may comprise, for example, a plurality of overlapping friction disks, which produce a false twist in the yarn. Within the false twist zone, the false twist returns in the yarn, and in so doing it is heated in the heating device 6 and subsequently set in the cooling device 7. The second feed system 14 withdraws the yarn from the false twist unit 15 and advances it to the takeup device 16. In the takeup device 16, the yarn 1 is wound to a package 17.

To cool the yarn 1 within the false twist zone, the cooling device 7 comprises a cooling tube 8 that connects via a line 10 to a coolant source 9. Associated to the cooling tube 8 is at the one end an inlet yarn guide 18, which advances the yarn 1 to the cooling tube 8. At the opposite end, an outlet yarn guide 19 is arranged. The end of the cooling tube 8 in the region of inlet yarn guide 18 is called the feed end 20, and the opposite end of the cooling tube 8 is called the delivery end 21. The coolant is supplied via the feed end 20, which connects via the line 10 to the coolant source 9. The coolant cools the wall of the cooling tube 8.

In the region between the inlet yarn guide 18 and the outlet yarn guide 19, the cooling tube 8 mounts on its circumference a yarn lifter 11. The yarn lifter 11 is formed by an annular segment 12, which is arranged on the circumference of the cooling tube 8. The annular segment 12 includes an outer guide edge 13, which extends in spaced relationship with the surface of the cooling tube 8 substantially in the radial direction.

Figure 2:
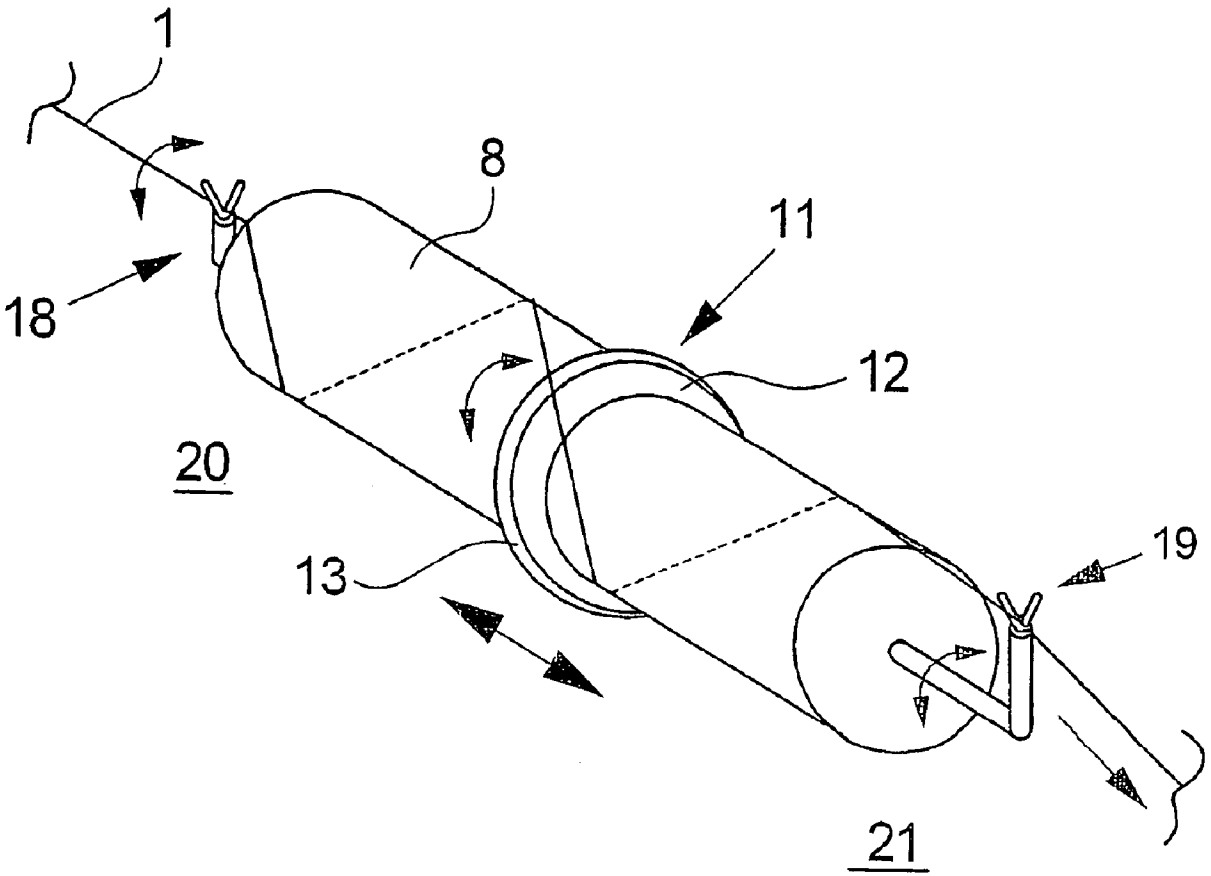
FIG. 2 is a schematic view of the cooling device of the texturing apparatus of FIG. 1.

FIG. 2 is a schematic view of the cooling device of the texturing apparatus of FIG. 1. The inlet yarn guide 18 and the outlet yarn guide 19 are made pivotal, so that the degree of the looping and thus the spiral cooling zone on the circumference of the cooling tube 8 are adjustable. In the region of the yarn lifter 11, the yarn 1 is guided over the guide edge 13 of the annular segment 12. With that, the contact between the yarn 1 and the surface of the cooling tube 8 is discontinued over a partial length. The size of the partial length is dependent on the spacing between the guide edge 13 and the surface of the cooling tube 8, as well as on the degree of slope of the spiral cooling zone on the circumference of the cooling tube 8. In this connection, it is possible to adjust the annular segment 12 on the circumference of the cooling tube 8 both in the axial direction and in the circumferential direction.

Figure 3:
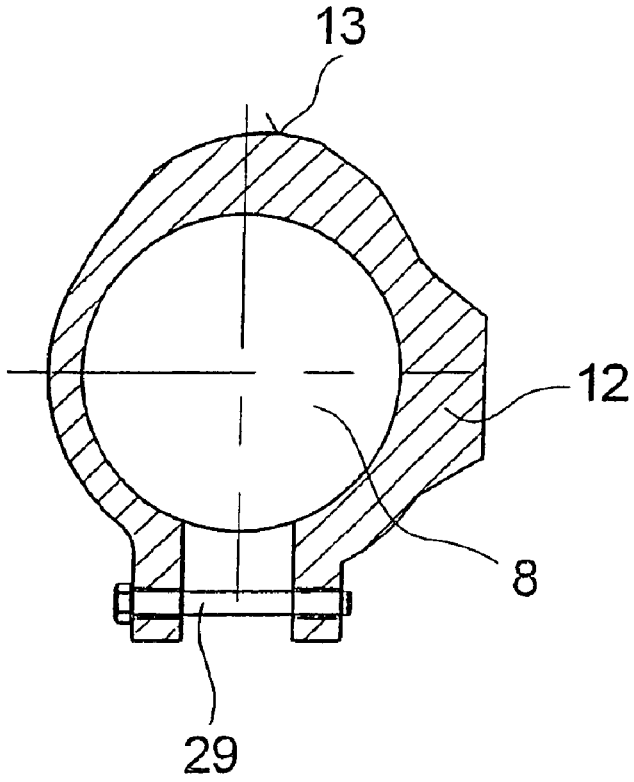
FIG. 3 is a schematic cross sectional view of the cooling device of the texturing apparatus of FIG. 1.

When the slope of the spiral cooling zone remains unchanged, the spacing between the guide edge 13 and the surface of the cooling tube 8 can be adjusted by displacing the annular segment 12. To this end, the annular segment 12 has an elliptic or stepped shape, as shown in FIG. 3. By adjusting the annular segment 12 on the cooling tube 8, it is thus possible to change the relative position of the yarn 1 on the guide edge 13, and with that the distance from the surface of the cooling tube 8. The configuration of the annular segment 12 is arbitrary, so that any spacing of the yarn is realizable. For example, the annular segment 12 may have a range, in which the yarn maintains a contact with the cooling tube 8.

The annular segment 12 is secured to the circumference of the cooling tube 8 by a fastening means 29. By releasing the fastening means 29, the annular segment 12 can be moved to any desired position on the circumference of the cooling tube 8.

Figure 4:
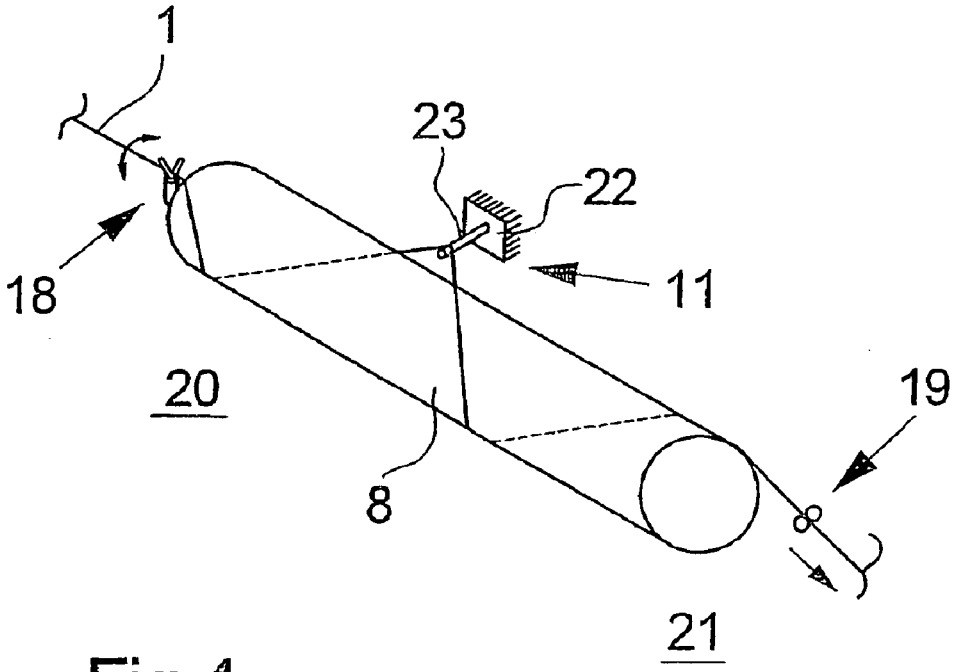
FIG. 4 is a schematic view of a further embodiment of the cooling device.

FIG. 4 illustrates a further embodiment of a cooling device 7, as could be used, for example, in the texturing apparatus shown in FIG. 1. In this embodiment, a yarn lifter 11 is associated to the cooling tube 8 between the inlet yarn guide 18 and the outlet yarn guide 19. The yarn lifter 11 is formed by a holder 22 and a yarn guide 23. The holder 22 is arranged on the side next to the cooling tube. The yarn guide 23 is in the form of a pin, and extends into the plane of the yarn path along the cooling tube 8. This arrangement causes the yarn 1 to advance within the cooling zone in the region of the cooling tube 8 over the yarn guide 23, so that in one section of the cooling zone, the yarn 1 is not in contact with the surface of the cooling tube 8.

Figure 5:
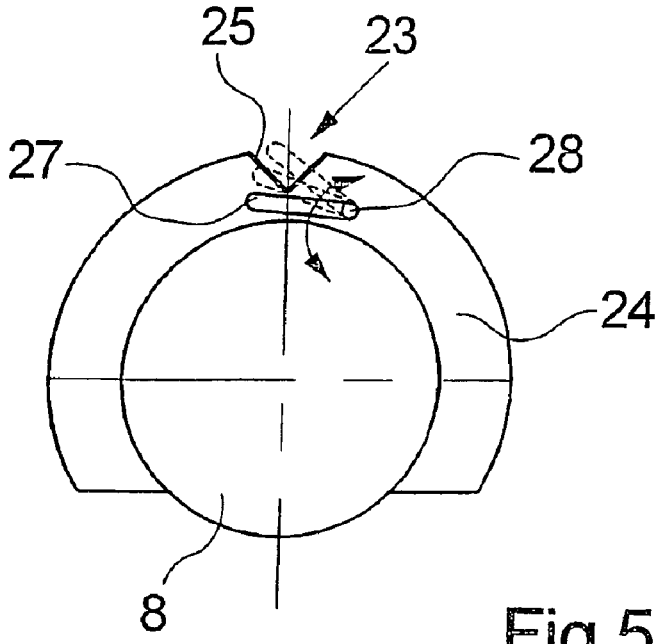
FIG. 5 is a schematic cross sectional view of a further embodiment of the cooling device.
Figure 6:
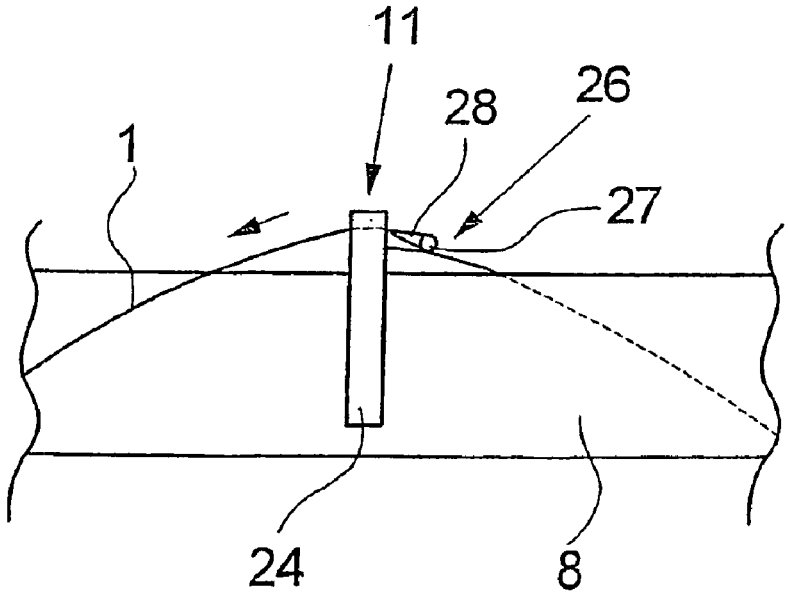
FIG. 6 is a schematic side view of the cooling device of FIG. 5.

FIGS. 5 and 6 illustrate a further embodiment of a cooling device 7, as could be used, for example, in a texturing apparatus of FIG. 1. Illustrated is only a section of the cooling tube 8 with a yarn lifter 11. In this connection, FIG. 5 is a cross sectional view of the cooling device 7, and FIG. 6 a side view thereof. The following description will apply to both Figures, unless express reference is made to one of the Figures.

The yarn lifter 11 is formed by an annular holder 24, which is slipped over the circumference of the cooling tube 8. The annular holder 24 includes an external groove 25, with the yarn 1 advancing in the bottom thereof. Between the bottom of the groove 25 and the surface of the cooling tube 8, a spacing is formed, so that the yarn 1 advances in one section of the spiral cooling zone without contacting the cooling tube 8.

In the path of the advancing yarn, a yarn brake 26 precedes the yarn lifter 11. The yarn brake 26 is formed by a brake pin 27, which is adjustably connected via a support 28 to the annular holder 24. In the path of the advancing yarn, the brake pin 27 is arranged upstream of the groove 25, with the position of the brake pin 27 being variable relative the bottom of the groove 25. With that, it becomes possible to guide the yarn 1 within the cooling zone along the circumference of the cooling tube 8 with or without an additional looping about the brake pin 27. The looping of yarn 1 about the brake pin 27 causes an additional yarn friction, which leads to a further decrease of the twist oscillations in the yarn 1 within the cooling zone. As a result, it is possible to texture in an advantageous manner in particular fine-denier yarns with a small total looping of <360°. Even in the case of small looping angles within the cooling zone on the cooling tube 8, the yarn brake 26 associated to the yarn lifter 11 allows an adequate decrease of the twist oscillations to be realized as far back as the inlet into the heating device 6.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A yarn false twist texturing apparatus comprising a yarn feed system for advancing a yarn along a path of travel, a yarn heater, a yarn cooling device, and a yarn twisting unit serially arranged along the yarn path of travel, said yarn cooling device comprising a cooling tube which defines a feed end adjacent the yarn heater, and an opposite delivery end, an inlet yarn guide positioned adjacent the feed end of the cooling tube, and an outlet yarn guide positioned adjacent the delivery end of the cooling tube, for guiding the advancing yarn spirally along a cooling zone on the outside periphery of the cooling tube, and a yarn lifter positioned between the inlet and outlet yarn guides for guiding the advancing yarn within the cooling zone over a partial length thereof wherein the advancing yarn is spaced from the outside periphery of the cooling tube, and wherein the yarn lifter is selectively moveable either in an axial direction so as to change the point along the length of the cooling tube at which the yarn is spaced from the outside periphery of the cooling tube, or in a direction so as to change the radial spacing of the yarn from the outside periphery of the cooling tube.

2. The texturing apparatus of claim 1, wherein the yarn lifter is formed by a holder and a yarn guide, with the holder supporting the yarn guide in spaced relationship with the outside periphery of the cooling tube.

3. The texturing apparatus of claim 2, wherein the holder is adjustable for changing the position of the yarn guide relative to the cooling tube in the axial and/or the radial direction.

4. The texturing apparatus of claim 2, wherein the holder is made annular so that it can be slipped over the cooling tube, and wherein the yarn guide is in the form of a groove on the circumference of the holder.

5. The texturing apparatus of claim 1, wherein the yarn lifter is in the form of an annular segment having an outer guide edge for guiding the yarn, with the annular segment being arranged on the circumference of the cooling tube.

6. The texturing apparatus of claim 5, wherein the annular segment has a shape such that the spacing formed between the guide edge and the surface of the outside periphery of the cooling tube is non-uniform in the circumferential direction of the cooling tube.

7. The texturing apparatus of claim 6, wherein the annular segment is supported so as to be adjustable on the outside periphery of the cooling tube in the axial and/or the circumferential direction.

8. The texturing machine of claim 1, further comprising a yarn brake associated with the yarn lifter, such that the brake generates an additional friction on the yarn advancing along the partial length of the cooling zone.

9. The texturing machine of claim 8, wherein the yarn brake is in the form of a brake pin which precedes the yarn lifter in the path of the advancing yarn and such that the yarn loops at least partially about the brake pin before advancing onto the yarn lifter.

10. The texturing apparatus of claim 9, wherein the yarn lifter is formed by a holder and a yarn guide, and wherein the brake pin is adjustably mounted to the holder.

11. The texturing apparatus of claim 1, wherein the inlet yarn guide and/or the outlet yarn guide are supported so as to be adjustable relative to the circumference of the cooling tube.

12. The texturing apparatus of claim 1 wherein the yarn feed system comprises a first feed system arranged upstream of the yarn heater and a second feed system arranged downstream of the yarn twisting unit.

13. A yarn false twist texturing apparatus comprising a yarn feed system for advancing a yarn along a path of travel, a yarn heater, a yarn cooling device, and a yarn twisting unit serially arranged along the yarn path of travel, said yarn cooling device comprising a cooling tube which defines a feed end adjacent the yarn heater, and an opposite delivery end, an inlet yarn guide positioned adjacent the feed end of the cooling tube, and an outlet yarn guide positioned adjacent the delivery end of the cooling tube, for guiding the advancing yarn spirally along a cooling zone on the outside periphery of the cooling tube, and a yarn lifter positioned between the inlet and outlet yarn guides for guiding the advancing yarn within the cooling zone over partial length thereof wherein the advancing yarn is spaced from the outside periphery of the cooling tube, and wherein the yarn lifter is formed by a holder and a yarn guide, with the holder supporting the yarn guide in spaced relationship with the outside periphery of the cooling tube.

14. The texturing apparatus of claim 13, wherein the holder is adjustable for changing the position of the yarn guide relative to the cooling tube in the axial and/or the radial direction.

15. The texturing apparatus of claim 13, wherein the holder is made annular so that it can be slipped over the cooling tube, and wherein the yarn guide is in the form of a groove on the circumference of the holder.

16. A yarn false twist texturing apparatus comprising a yarn feed system for advancing a yarn along a path of travel, a yarn heater, a yarn cooling device, and a yarn twisting unit serially arranged along the yarn path of travel, said yarn cooling device comprising a cooling tube which defines a feed and adjacent the yarn heater, and an opposite delivery end, an inlet yarn guide positioned adjacent the feed end of the cooling tube, and an outlet yarn guide positioned adjacent the delivery end of the cooling tube, for guiding the advancing yarn spirally along a cooling zone on the outside periphery of the cooling tube, a yarn lifter positioned between the inlet and outlet yarn guides for guiding the advancing yarn within the cooling zone over a partial length thereof wherein the advancing yarn is spaced from the outside periphery of the cooling tube, and a yarn brake associated with the yarn lifter, such that the brake generates an additional friction on the yarn advancing along the partial length of the cooling zone.

17. The texturing machine of claim 16, wherein the yarn brake is in the form of a brake pin which precedes the yarn lifter in the path of the advancing yarn and such that the yarn loops at least partially about the brake pin before advancing onto the yarn lifter.

18. The texturing apparatus of claim 17, wherein the yarn lifter is formed by a holder and yarn guide, and wherein the brake pin is adjustably mounted to the holder.

19. A yarn false twist texturing apparatus comprising a yarn feed system for advancing a yarn along a path of travel, a yarn heater, a yarn cooling device, and a yarn twisting unit serially arranged along the yarn path of travel, said yarn cooling device comprising a cooling tube which defines a feed end adjacent the yarn heater, and opposite delivery end, an inlet yarn guide positioned adjacent the feed end of the cooling tube, and an outlet yarn guide positioned adjacent the delivery end of the cooling tube, for guiding the advancing yarn spirally along a cooling zone on the outside periphery of the cooling tube, and a yarn lifter positioned between the inlet and outlet yarn guides for guiding the advancing yarn within the cooling zone over a partial length thereof wherein the advancing yarn is spaced from the outside periphery of the cooling tube, said yarn lifter being in the form of an annular segment having an outer guide edge for guiding the yarn, with the annular segment being arranged on the circumference of the cooling tube, wherein the annular segment has a shape such that the spacing formed between the outer guide edge and the surface of the outside periphery of the cooling tube is non-uniform in the circumferential direction of the cooling tube, and wherein the annular segment is supported so as to be adjustable on the outside periphery of the cooling tube in the axial and/or the circumferential direction.

* * * * *